United States Patent [19]

Lake

[11] Patent Number: 4,864,657

[45] Date of Patent: Sep. 12, 1989

[54] BACK-CLOSURE ROBE

[76] Inventor: Dorothy H. Lake, 9 Oakwood Dr., Glens Falls, N.Y. 12801

[21] Appl. No.: 251,190

[22] Filed: Sep. 29, 1988

[51] Int. Cl.[4] ..... A41D 10/00

[52] U.S. Cl. ..... 2/114; 2/83; 2/69; 2/DIG. 7

[58] Field of Search ..... 2/113, 114, 83, 93, 2/69, DIG. 7, 74, 75

[56] References Cited

U.S. PATENT DOCUMENTS

| | | | |
|---|---|---|---|
| 2,497,764 | 2/1950 | Doughty | 2/114 |
| 2,686,914 | 8/1954 | Weiser | 2/114 |
| 2,707,282 | 5/1955 | Paterson | 2/114 |
| 3,369,256 | 2/1968 | Kern | 2/114 |
| 3,399,406 | 9/1968 | Bradely | 2/114 |
| 3,689,939 | 9/1972 | Taylor | 2/114 |
| 3,824,625 | 7/1974 | Green | 2/114 |
| 3,935,596 | 2/1976 | Allen, Jr. et al. | 2/114 |
| 4,296,497 | 10/1981 | Herman | 2/114 |
| 4,384,370 | 5/1983 | Singer | 2/114 |
| 4,523,336 | 6/1985 | Truman | 2/114 X |
| 4,570,268 | 2/1986 | Freeman | 2/114 |
| 4,571,743 | 2/1986 | Wagoner | 2/88 |
| 4,578,825 | 4/1986 | Vote | 2/114 |
| 4,653,120 | 3/1987 | Leaf | 2/114 |
| 4,674,132 | 6/1987 | Stein et al. | 2/114 |
| 4,698,848 | 10/1987 | Buckley | 2/114 |
| 4,718,124 | 1/1988 | Sawicki et al. | 2/114 |

*Primary Examiner*—Werner H. Schroeder
*Assistant Examiner*—Jeanette E. Chapman
*Attorney, Agent, or Firm*—Heslin & Rothenberg

[57] ABSTRACT

An improved garment is disclosed having a conventional robe-type front portion and a vertically extending opening in the back portion from the collar to the hemline such that two back closing sections are defined. The back closing sections are sized to significantly overlap the full length of the back portion. Securing means are provided at the collar and shoulder area of the back portion for ready securement of the garment about an individual.

5 Claims, 2 Drawing Sheets

BACK-CLOSURE ROBE

TECHNICAL FIELD

The present invention relates to clothing and more particularly to a garment in the form of a robe which is specially adapted for invalid or semi-invalid individuals.

BACKGROUND OF THE INVENTION

The back-closure robe was developed as a simple, practical way to provide coverage and warmth for a hospitalized patient who is either unable to dress himself, unable to stand or walk without the assistance of an attendant, is mentally confused, or is restrained to a chair by means of a restraining vest. For example, in order to dress a patient wearing a restraining vest (and seated in a chair) with a conventional robe, at least two aides must typically be present to: (1) untie the vest, (2) stand the patient and hold him, (3) remove the restraining vest, (4) put the robe on him, (5) replace the vest, (6) seat the patient, and (7) retie the vest to the chair. The procedure is stressful to the patient, and time consuming and inconvenient for the staff. In the case of an incontinent patient, with a conventional robe the procedure must be repeated when the robe becomes damp. Further, with a conventional robe the restraining vest remains visible.

The back-closure robe of the present invention was specifically designed to address these problems. The number of steps required to secure the back-closure robe about a patient wearing a restraining vest has been reduced from seven with a conventional robe to just one with the present invention. The back-closure robe is simply placed on a patient while he is seated, and fastened across the upper back at shoulder level. It is not necessary to remove the restraining vest or untie it from the chair to which it is attached. The patient is not inconvenienced and only one assistant is required to dress the patient. Because the back-closure robe preferably falls to the sides of the chair and is not under the seated wearer, there is no reason for it to become damp from the incontinence of the patient. Full coverage and warmth are afforded the patient at his upper back, shoulders, arms, neck, sides, and front. The restraining vest remains under the robe and is essentially invisible. No moving or lifting of the patient is necessary, thereby eliminating the physical and emotional stress normally experienced by the patient when dressed in a conventional robe. When the patient is given walking therapy, the back-closure robe is designed to overlap sufficiently in back to afford complete coverage and dignity. A belt can be added for extra security and appearance.

One prior art hospital robe is disclosed by A. Kern in U.S. Pat. No. 3,369,256. The Kern robe was designed principally for hospital use and includes a front portion presenting the appearance of a normal robe and a back portion having a full length opening from a neckline point to a hemline. The robe has marginally overlapping sections along the full length of the back opening and is provided with multiple fasteners from the neckline defined opening to the hemline to afford the patient with secure coverage.

The back-closure robe has been specifically designed to overcome several functional deficiencies of the Kern robe and other known robes. Specifically, the Kern robe is difficult to secure about a patient in a manner such as to afford complete coverage to the patient. An attendant (or attendants) must stand the patient and secure the individual multiple fasteners down the length of the full back opening. The back-closure robe, on the other hand, has been designed such that it can easily be placed about a patient in a seated position or a standing position with only limited securing means located along the back shoulder and collar area of the robe. Often, a patient within a restraining vest is very combatant and minimizing dressing time is important both for the patient and the attendant(s). Further, the Kern design requires that the robe be positioned underneath a seated wearer when fully secured which, again, is problematic if the wearer is incontinent. If the Kern robe is only fastened at the neckline, there is little coverage of the individual's back when the wearer is seated and the robe is not under him but rather draped to the sides of the chair. Coverage of the patient's back with the Kern robe requires the extra step of fastening the snap buttons to approximately waist level. However, at the minimum this would require that the patient be moved forward within the chair, possibly also requiring untieing of the restraining vest, and once the wearer stands, the remaining snap buttons would have to be affixed on the back of the robe to insure secure coverage. With the back-closure design of the present invention, these considerations are eliminated. Lastly, gapping above and below the snap closures of the Kern robe will typically occur with most fabric types, particularly after repeated laundering and wearing which apply stress to the fabric at the snap points.

SUMMARY OF THE INVENTION

Briefly, the present invention comprises an improved garment comprising a robe-like structure having a front portion which presents the appearance of a conventional bathrobe and a back portion with a full length opening from a collar defined opening to a hemline. The front portion is sewn to be substantially unopenable from the collar defined opening to the hemline. The full length opening of the back portion defines two back closing sections. The upper portions of the back closing sections define a shoulder area. Securing means are located on the back portion only near the collar and shoulder area to facilitate ready securement of the robe like structure about an individual in either a seated position or a standing position. The two back closing sections are sized to sufficiently overlap along the full length back opening such that the back of the individual wearing the garment is substantially covered when the individual is seated on a chair and the lower parts of the back closing section are positioned about the sides of the chair. Further, the back closing sections are sized to sufficiently overlap such that the back closing sections automatically drop to completely cover the back of the individual when the individual stands from such a seated position.

Accordingly, a principal object of the present invention is to provide an improved robe like structure capable of being conveniently secured about a patient and capable of maintaining full patient coverage.

Another object of the present invention is to provide a robe-like structure for covering a mobility deficient person with an attractive, functional garment which may be applied with a minimum amount of physical and emotional stress to the afflicted person.

BRIEF DESCRIPTION OF THE DRAWINGS

While the specification concludes with claims particularly pointing out and distinctly claiming the present invention, the objects, features and advantages of the invention can be more readily ascertained from the following detailed description of one preferred embodiment when read in conjunction with the accompanying drawings in which:

DETAILED DESCRIPTION OF THE INVENTION

Figure 1:
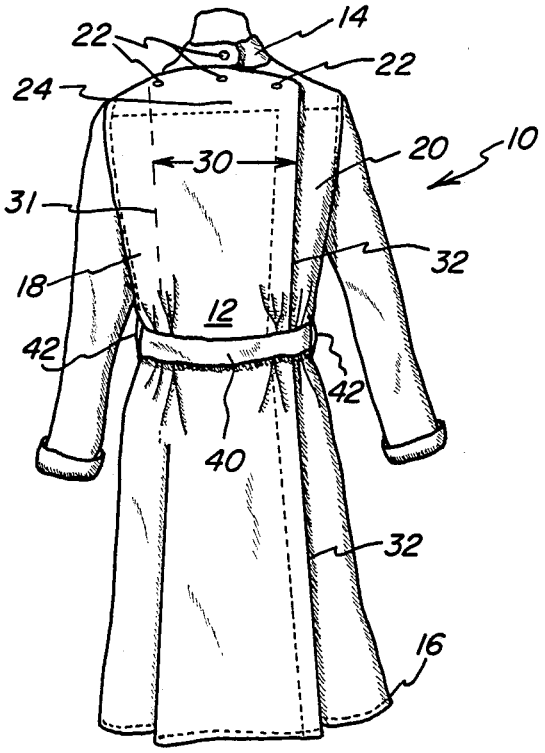
FIG. 1 is a back view of the back-closure robe of the present invention.

As shown in FIG. 1, the back-closure robe of the present invention, generally denoted 10, consists in part of a back portion 12. Back portion 12 has a full length opening from a collar 14 to an approximately knee length hemline 16. The full back opening defines two back closing sections 18 and 20 (see also FIGS. 3 and 5). Closing sections 18 and 20 have a wide overlap along the full length opening such that a wearer is fully covered when standing. Securing means such as snap fasteners 22 are provided on the collar 14 and shoulder area 24 of back portion 12. As shown, three snap fasteners 22 are preferably provided in the shoulder region and one is provided on collar 14. The concentration of snap fasteners 22 on the upper part of the back portion 12 define a focal point for an attendant to readily secure the back closure robe about a patient, notwithstanding whether the patient is seated or standing and whether or not the patient is combatant.

As noted, back closing sections 18 and 20 overlap along the length of the back opening when the back closure robe is secured about a patient and the patient is standing. The overlapping 30, defined by edge 31 of the inner closing section 20 and edge 32 of the outer closing section 18 is shown to comprise a substantial part of the width of back portion 12. Again, overlapping 30 must be sufficient to accomplish the object of providing full coverage of the back of the patient when standing with the affixed securing means only located at the shoulder/collar area of the robe and sufficient to substantially cover the back of the patient when the patient is seated in a chair with the robe draped to the sides of the chair, as discussed further below.

If desired, a conventional belt 40 can be utilized, along with belt carriers 42, for providing a more conventional appearance and for positively securing the back portion of robe 10 closed.

Figure 2:
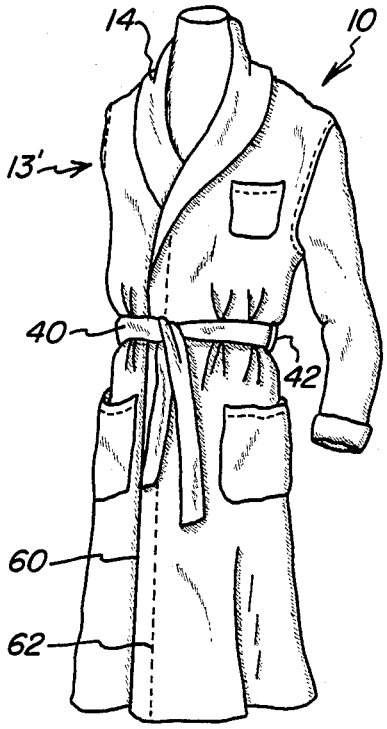
FIG. 2 is a front view of the robe shown in FIG. 1.

FIG. 2 shows a classic version of the robe front 13. The shawl collar 14 front is shown for illustration but may vary in style. The front closure 60 is permanently sewn substantially closed at 62. This feature is a requirement of the back-closure robe. The front view of the tie belt 40 and one of the two belt carriers 42 is also shown. Dotted lines indicate stitching and construction detail.

Figure 2A:
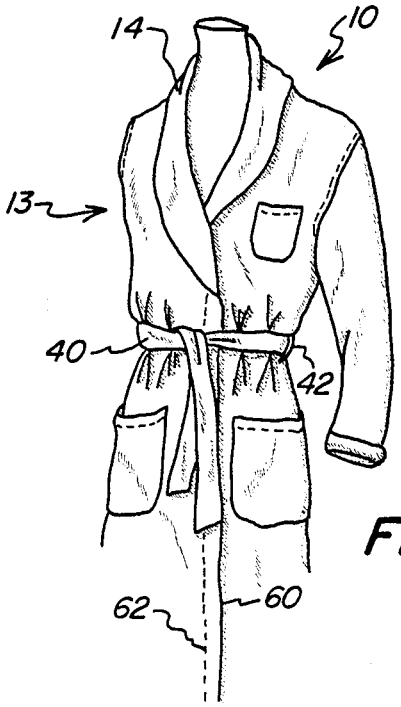
FIG. 2A is an alternate version of the robe front illustrated in FIG. 2.

FIG. 2A has the obverse front 13' construction of that embodiment illustrated in FIG. 2. Right and left front closings 60 of FIGS. 2 and 2A are the conventional preferences for men and women. In both instances, front overlaps are permanently joined at 62.

Figure 3:
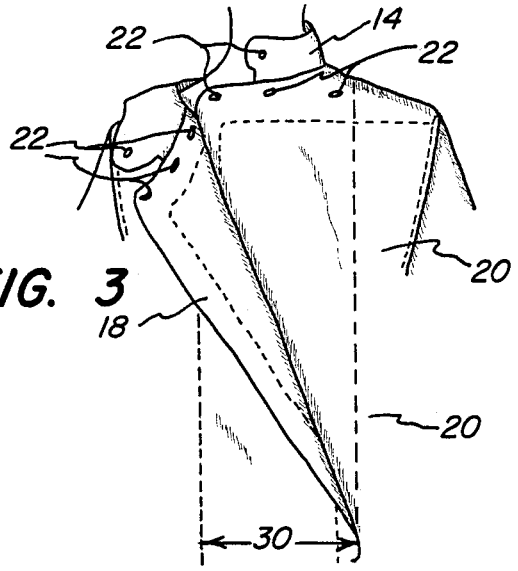
FIG. 3 is a partial back view of the back-closure robe of FIG. 1 shown in a partially opened position.

The back closure robe 10 is shown in a partially open position in FIG. 3 with the overlap 30 partially folded back. Broken lines 60 indicate placement when closed. The collar 14 on the right side of the drawing is shown in an open, upright position; the left half of collar 14 is shown lying flat on the shoulder. Snap fasteners 22 are indicated in open position at shoulder and collar level.

Figure 4:
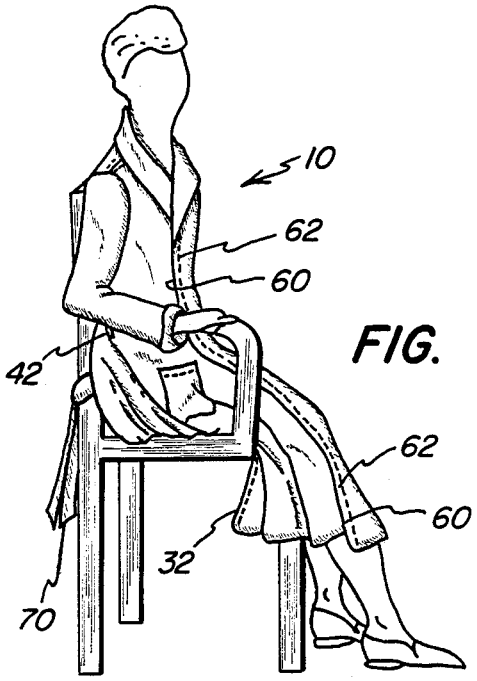
FIG. 4 is a side view of a seated individual wearing the robe of the present invention.

The seated patient in FIG. 4 shows the robe from a side view. The robe back vertical closing sections fall to the side of the individual and the chair while remaining in place at the upper back (see FIG. 5). Because the front portion is permanently closed, the robe provides complete coverage when the patient is seated. Restraining vest ties 70 are shown in a typical position when the wearer is seated. The ties are not visible from the front and are only minimally evident from the side when the robe 10 is secured about the individual. The ties are not a part of the robe but are shown for clarification. Diagonal lines indicate the chair.

Figure 5:
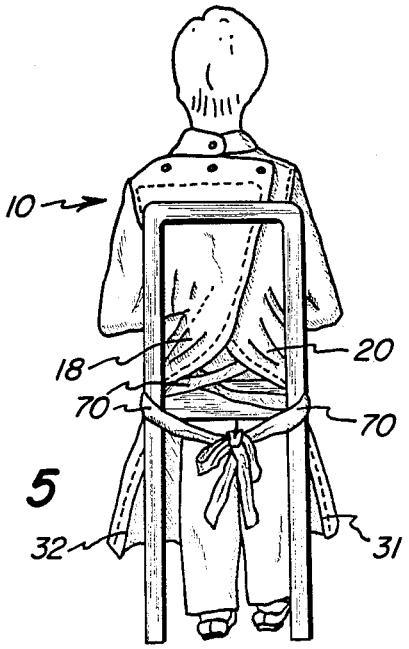
FIG. 5 is a back view of the seated individual and robe shown in FIG. 4.

Another view of the seated figure is shown in FIG. 5. As shown, the robe is closed at the collar 14 and shoulder area 24 with snap fasteners 22. The vertical back edges 31 and 32 of the robe closing sections 20 and 18, respectively, are shown in an open position, falling to the sides of the patient and the chair. This view shows the complete coverage of the patient's upper back, shoulders, and arms without the necessity of placement under the seat of the patient. Conventional restraining vest ties 70 are shown positioned under the robe and tied to the chair.

Although a specific embodiment of the present invention has been described in detail above, it is to be understood that this is only for purposes of illustration. Modifications may be made to the described structure to adopt the invention without departing from the scope or spirit of the attached claims.

I claim:

1. An improved garment comprising:

a robe-like structure having a front portion which presents the appearance of a conventional bathrobe including a collar, said structure being sewn such that said front portion is substantially unopenable from a collar defined opening to a hemline of at least approximately knee length;

said robe-like structure having a back portion with a full length opening from the collar defined opening to the hemline such that two back closing sections are defined, said back portion having a shoulder area which comprises an upper part of each of said two back closing sections;

securing means located on said back portion only near the collar and the shoulder area of said back portion to facilitate ready securement of the robe-like structure about an individual in either a seated position or a standing position; and said back closing sections being sized to sufficiently overlap along said back opening such that the back of an individual wearing the garment is substantially covered when the individual is seated on a chair with the lower parts of said back closing sections positioned about his sides, and such that said back closing sections automatically overlap to completely cover the back of the individual when the individual stands from such a seated position.

2. The improved garment of claim 1, wherein said securing means comprises a plurality of snap fasteners.

3. The improved garment of claim 2, wherein said securing means comprises three snap fasteners located on the shoulder area of said back portion and one snap button located on the collar at said back portion.

4. The improved garment of claim 1, wherein the width of said back closing sections' overlap is approximately that of the width of said back portion.

5. The improved garment of claim 1, further comprising a waist belt securable about the robe-like structure when said structure is worn by an individual.

* * * * *